US007922280B2

(12) United States Patent
Griesemer et al.

(10) Patent No.: US 7,922,280 B2
(45) Date of Patent: Apr. 12, 2011

(54) MAINTENANCE STATION FOR AN IMAGING APPARATUS

(75) Inventors: Frederick Charles Griesemer, Lexington, KY (US); Marc Alan Herwald, Lexington, KY (US); Martin Alan Johnson, Winchester, KY (US); Daniel Robert LaBar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1276 days.

(21) Appl. No.: 11/464,312

(22) Filed: Aug. 14, 2006

(65) Prior Publication Data

US 2006/0284921 A1 Dec. 21, 2006

Related U.S. Application Data

(62) Division of application No. 10/461,981, filed on Jun. 13, 2003, now Pat. No. 7,140,715.

(51) Int. Cl.
*B41J 2/165* (2006.01)
*B41J 2/015* (2006.01)

(52) U.S. Cl. ..... 347/29; 347/32; 347/20

(58) Field of Classification Search ..... 347/29–36, 347/20, 23

See application file for complete search history.

(56) References Cited

U.S. PATENT DOCUMENTS 3,986,091 A 10/1976 Quiogue et al.
4,144,537 A 3/1979 Kimura et al.
4,789,874 A 12/1988 Majette et al.
5,440,331 A 8/1995 Grange
5,455,609 A 10/1995 Gast et al.
5,602,573 A 2/1997 Waschhauser et al.
5,621,441 A 4/1997 Waschhauser et al.
5,627,574 A 5/1997 Fahy
5,640,182 A * 6/1997 Bahrami et al. ..... 347/33
5,644,346 A 7/1997 Schwiebert et al.
5,659,341 A 8/1997 Kinas
5,689,293 A 11/1997 Hirano
5,714,991 A * 2/1998 Osborne et al. ..... 347/30
5,774,139 A * 6/1998 Salzer et al. ..... 347/32
5,801,725 A 9/1998 Neese et al.
5,812,157 A 9/1998 Nguyen et al.
5,847,727 A 12/1998 VanLiew et al.
5,886,714 A * 3/1999 Burney et al. ..... 347/33
5,917,516 A 6/1999 Nguyen et al.
5,966,146 A 10/1999 Lee
5,992,967 A 11/1999 Nguyen et al.
6,000,780 A 12/1999 Schwiebert et al.
6,135,585 A 10/2000 Johnson et al.
6,168,257 B1 1/2001 Aldrich
6,193,353 B1 * 2/2001 Vives et al. ..... 347/29
6,238,035 B1 * 5/2001 Barinaga ..... 347/28
6,280,015 B1 8/2001 Nguyen et al.
(Continued)

*Primary Examiner* — Stephen D Meier
*Assistant Examiner* — Leonard S Liang
(74) *Attorney, Agent, or Firm* — John Victor Pezdek

(57) ABSTRACT

An imaging apparatus includes a frame and a maintenance sled movably coupled to the frame. The maintenance sled includes a carrier engagement member. A printhead carrier is coupled to the frame. A carrier motor is drivably coupled to the printhead carrier. A controller is coupled to the carrier motor. The controller controls the carrier motor to drive the printhead carrier at a first velocity and at a second velocity. The second velocity is lower than the first velocity. The printhead carrier is controlled to move at the first velocity toward the maintenance sled, wherein prior to the printhead carrier contacting the carrier engagement member of the maintenance sled, the printhead carrier is decelerated from the first velocity to the second velocity.

19 Claims, 7 Drawing Sheets

U.S. PATENT DOCUMENTS 6,334,663 B1 * 1/2002 Lee ..... 347/29
6,398,340 B1 * 6/2002 Lin ..... 347/33
6,402,290 B1 6/2002 Johnson et al.
6,422,679 B1 7/2002 Aldrich
6,481,822 B2 11/2002 Murcia et al.
6,499,824 B1 12/2002 Nitta
6,533,388 B2 * 3/2003 Toh et al. ..... 347/33
6,672,696 B2 * 1/2004 Fairchild et al. ..... 347/8
6,682,167 B2 1/2004 Davis et al.
6,869,164 B2 3/2005 Johnson et al.
2002/0167562 A1 11/2002 Arai et al.
2003/0210296 A1 * 11/2003 Ma et al. ..... 347/32

* cited by examiner

MAINTENANCE STATION FOR AN IMAGING APPARATUS

CROSS REFERENCE TO RELATED APPLICATIONS

This is a division of U.S. patent application Ser. No. 10/461,981, entitled "MAINTENANCE STATION FOR AN IMAGING APPARATUS", filed Jun. 13, 2003 now U.S. Pat. No 7,140,715.

BACKGROUND OF THE INVENTION

1. Field of the Invention

The present invention relates to performing printhead maintenance in an imaging apparatus, and more particularly, to an imaging apparatus that reduces the amount of noise generated during printhead maintenance.

2. Description of the Related Art

An imaging apparatus, such as an ink jet printer, includes a maintenance station that performs maintenance operations to preserve the life of the associated printhead. For example, an ink jet printer includes an ink jet printhead having a plurality of ink jetting nozzles formed in a nozzle plate. Such a maintenance station for an ink jet printer includes a printhead wiper and a printhead capping mechanism. The printhead wiper is used for wiping residual ink from the nozzles of the ink jet printhead after completion of printing and the capping mechanism is used to cap the ink jet printhead for storage. The wiping and capping operations prevent the nozzles from becoming blocked with contaminants, such as dried ink and accumulated paper dust, thereby extending the life of the ink jet printhead.

One such maintenance station is configured to minimize the occupied space. The maintenance station includes a movable maintenance sled that supports the wiper and capping mechanism. A maintenance housing surrounds the maintenance sled and includes guide slots for receiving corresponding guide pins of the maintenance sled. When the printhead carrier that carriers the ink jet printhead engages an engaging member of the maintenance sled, the guide pins are caused to ride along the guide slots, enabling the movable maintenance sled to be shifted from a lowered position to a raised position, where the printhead cap engages the ink jet printhead. However, when the movable maintenance sled is moved from a lowered position to the raised position, an unacceptable amount of noise may be generated, for example, due to the impact of the printhead carrier with the engaging member of the maintenance sled, the printhead carrier impacting a hard stop at the capping position, and/or as the guide pins of the maintenance sled contact a surface of the respective guide slots in the maintenance housing, such as the rigid end-stops of the respective guide slots of the maintenance housing.

What is needed in the art is an imaging apparatus that reduces the amount of noise generated during printhead maintenance.

SUMMARY OF THE INVENTION

The present invention provides an imaging apparatus that reduces the amount of noise generated during printhead maintenance.

The invention, in one form thereof, relates to an imaging apparatus including a frame and a maintenance sled movable coupled to the frame. The maintenance sled includes a carrier engagement member. A printhead carrier is coupled to the frame. A carrier motor is drivably coupled to the printhead carrier. A controller is coupled to the carrier motor. The controller controls the carrier motor to drive the printhead carrier at least at the first velocity and at a second velocity. The second velocity is lower than first velocity. The printhead carrier is controlled to move at the first velocity toward the maintenance sled, wherein prior to the printhead carrier contacting the carrier engagement member of the maintenance sled, the printhead carrier is decelerated from the first velocity to the second velocity.

The invention, in another form thereof, relates to an imaging apparatus including a frame and a printhead carrier coupled to the frame. A maintenance sled is movably coupled to the frame. The maintenance sled includes a carrier engagement member having a contact surface that is shaped to establish a single line of contact with the printhead carrier.

In another form thereof, the invention relates to an imaging apparatus including a frame and a maintenance housing coupled to the frame. A maintenance sled is movable mounted to the maintenance housing. A sled latch mechanism has a pivot pin that is pivotable mounted to the maintenance sled along a pivot axis, and has an arm portion extending from the pivot pin. A pivot stop member is positioned near the pivot axis. The pivot stop member engages the arm portion of the sled latch mechanism to limit an amount of rotation of the sled latch mechanism about the pivot axis.

In still another form thereof, the invention relates to a method of effecting noise reduction in an imaging apparatus having a movable printhead carrier and a maintenance station. The maintenance station includes a movable maintenance sled having a carrier engagement member. The method includes the steps of controlling the printhead carrier to travel at least at a first velocity and at a second velocity, the second velocity being lower than the first velocity; moving the printhead carrier toward the maintenance station at the first velocity; and prior to the printhead carrier contacting the carrier engagement member of the maintenance sled, decelerating the printhead carrier from the first velocity to the second velocity.

In still another form thereof, the invention relates to an imaging apparatus including a frame defining a carrier hard stop position. A printhead carrier is coupled to the frame. A carrier motor is drivably coupled to the printhead carrier. A controller is coupled to the carrier motor. The controller controls the carrier motor to drive the printhead carrier at least at a first velocity. The printhead carrier is controlled to move toward the carrier hard stop position, wherein prior to the printhead carrier contacting the carrier hard stop position the printhead carrier is controlled to achieve a carrier soft stop position spaced apart from the carrier hard stop position.

An advantage of the present invention is that the noise associated with the maintenance station is reduced without increasing the part count of the maintenance station.

BRIEF DESCRIPTION OF THE DRAWINGS

The above-mentioned and other features and advantages of the invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several view. The exemplifications set out herein illustrate an embodiment of the invention, in one form, and such exemplifications are not to be construed as limiting the scope of the invention in any manner.

DETAILED DESCRIPTION OF THE INVENTION

Figure 1:
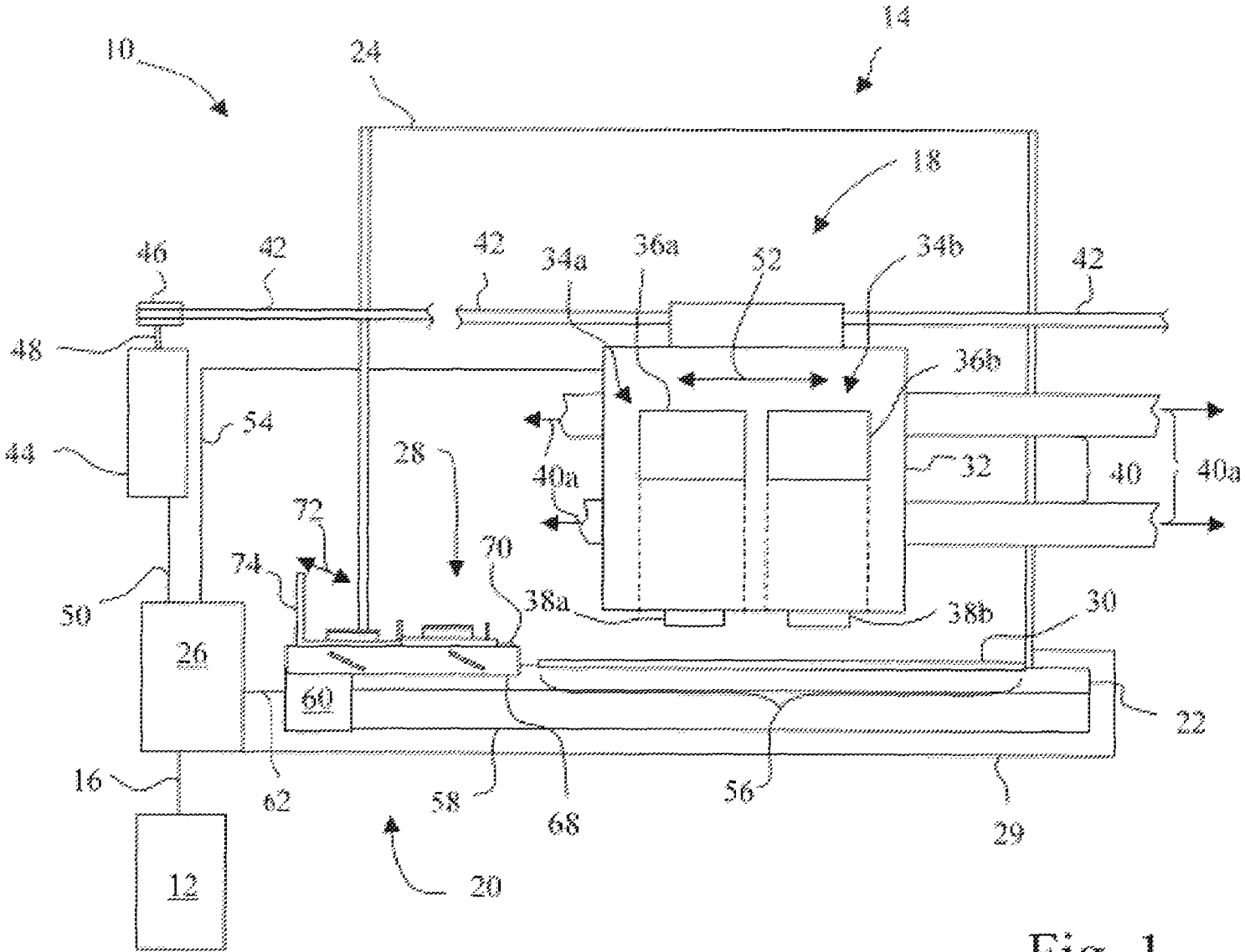
FIG. 1 is a diagrammatic representation of an imaging system employing an embodiment of the present invention.
Figure 2:
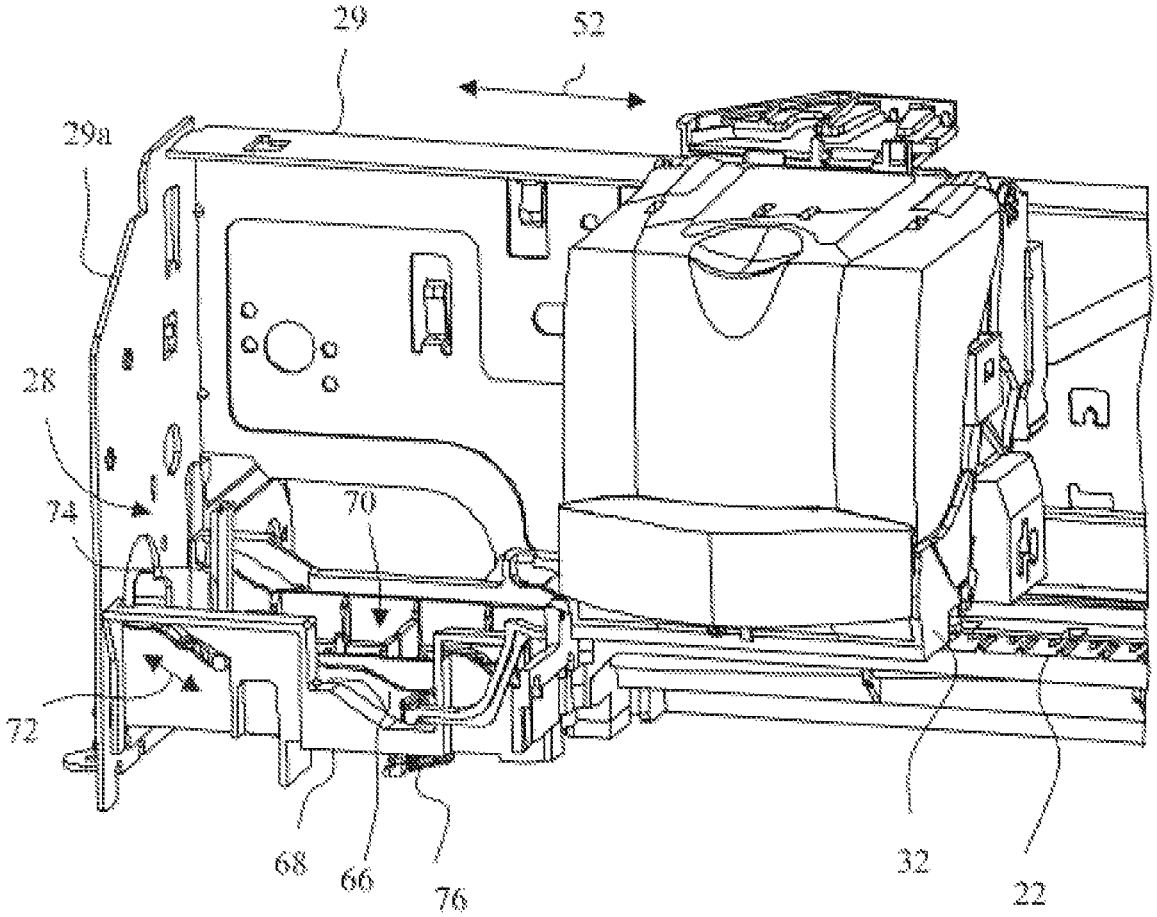
FIG. 2 is a perspective view of a portion of the imaging apparatus diagrammatically represented in FIG. 1.

Referring now to the drawings and more particularly to FIGS. 1 and 2, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and includes a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer drive software. The printer drive software places print data and print commands in a format that can be recognized by ink jet printer 14.

Ink jet printer 14 includes a printhead carrier system 18, a feed roller unit 20, a mid-frame 22, a media source 24, a controller 26 and a maintenance station 28. Printhead carrier system 18, feed roller unit 20, mid-frame 22, media source 24, controller 26 and maintenance station 28 are coupled, e.g., mounted, to imaging apparatus frame 29.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 that carries, for example, one or more printhead cartridges, such as a monochrome printhead cartridge 34*a* and/or a color printhead cartridge 34*b*, that is mounted thereto. Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits.

Printhead carrier 32 is guided by a pair of guide members 40. Either, or both, of guide members 40 may be, for example, a guide rod, or a guide tab formed integral with imaging apparatus frame 29. The axes 40*a* of guide members 40 define a bi-directional scanning path 52 of printhead carrier 32. Printhead carrier 32 is connected to a carrier transport belt 42 that is driven by a carrier motor 44 via a carrier pulley 46. In this manner, carrier motor 44 is drivably coupled to printhead carrier 32, although one skilled in the art will recognize that other drive coupling arrangements could be substituted for the example given, such as for example, a worm gear drive. Carrier motor 44 can be, for example, a direct current motor of a stepper motor. Carrier motor 44 has a rotating motor shaft 48 that is attached to carrier pulley 46. Carrier motor 44 is coupled, e.g., electrically connected, to controller 26 via a communications link 50.

At a directive of controller 26, printhead carrier 32 is transported in a controlled manner along bi-directional scanning path 52, via the rotation of carrier pulley 46 imparted by carrier motor 44. During printing, controller 26 controls the movement of printhead carrier 32 so as to cause printhead carrier 32 to move in a controlled reciprocating manner, back and forth along guide members 40. In order to conduct printhead maintenance operations, controller 26 controls the movement of printhead carrier 32 to position printhead carrier in relation to maintenance station 28.

Ink jet printheads 38*a*, 38*b* are electrically connected to controller 26 via a communications link 54. Controller 26 supplies electrical address and control signals to ink jet printer 14, and in particular, to the ink jetting actuators of ink jet printheads 38*a*, 38*b*, to effect the selective ejection of ink from ink jet printheads 38*a*, 38*b*.

During a printing operation, the reciprocation of printhead carrier 32 transports ink jet printheads 38*a*, 38*b* across the sheet of print media 30 along bi-directional scanning path 52, i.e., a scanning direction, to define a print zone 56 of ink jet printer 14. Bi-directional scanning path 52, also referred to as scanning direction 52, is parallel with axes 40*a* of guide members 40, and is also commonly known as the horizontal direction. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

During each scan of printhead carrier 32, the sheet of print media 30 is held stationary by feed roller unit 20. Feed roller unit 20 includes a feed roller 58 and a drive unit 60.

Maintenance station 28 is provided for performing printhead maintenance operations on the ink jet nozzles of ink jet printheads 38*a*, 38*b*. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art.

Maintenance station 28 includes a sled latch mechanism 66, a maintenance housing 68 and a movable maintenance sled 70. Maintenance housing 68 supports movable maintenance sled 70. Maintenance sled 70 is configured for movement in the directions depicted by double-headed arrow 72.The directions generally depicted by double-headed arrow 72 include both horizontal and vertical Components. Sled latch mechanism 66 is pivotably mounted so maintenance sled 70. Sled latch mechanism 66 cooperates with maintenance housing 68 and maintenance sled 70 to releaseably latch maintenance sled 70 at a predefined elevation, such as for example, an intermediate, or wiping, elevation.

Maintenance sled 70 includes a carrier engagement member 74. Maintenance sled 70 is biased by biasing spring 76 in a direction toward printhead carrier 32. The spring force exerted by biasing spring 76 must be sufficient to accelerate maintenance sled 70 and its associated components to the lowered (resting) position so that they are clear of printhead carrier 32 and ink jet printheads 38*a*, 38*b* as printhead carrier 32 returns to print zone 56. In one embodiment of the invention, biasing spring 76 is attached at one end thereof to sled latch mechanism 66.

With the orientation of components as shown in FIGS. 1 and 2, a leftward movement of printhead carrier 32 causes printhead carrier 32 to engage carrier engagement member 74, thereby causing maintenance sled 70 to move to the left and upward, as illustrated by arrow 72, progressing from a lowered, or rest, elevation to an intermediate, or wiping, elevation, and progressing from the wiping elevation to the full raised, or capping, elevation.

Figure 3:
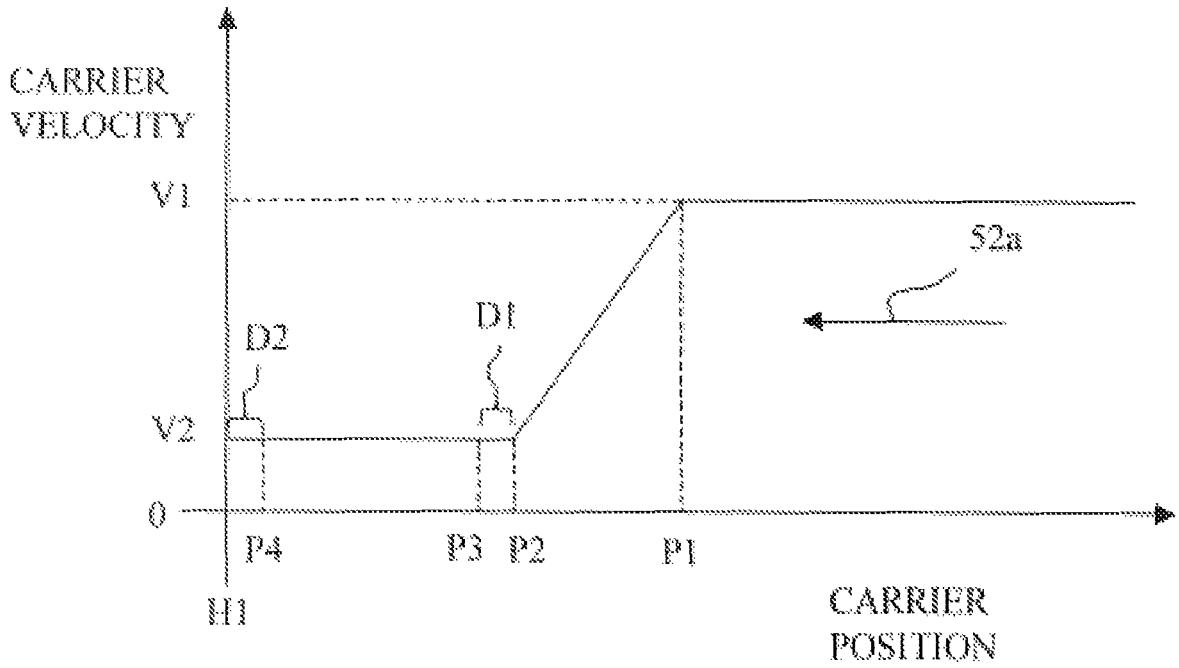
FIG. 3 is a graphical depiction relating carrier velocity to carrier position.

FIG. 3 is a graph relating carrier velocity to carrier position, based on a configuration and orientation of components as shown in FIGS. 1 and 2. Several carrier positions are specifically identified in FIG. 3, and labeled P1, P2, P3 and P4, in relation to a carrier hard stop position H1. Carrier hard stop position H1 represents a position at which printhead carrier 32 would impact side frame 29*a* of imaging apparatus frame 29, if movement of printhead carrier 32 is not stopped prior to such occurrence.

Based on a leftward movement in direction 52*a* of printhead carrier 32 along bi-directional scan path 52, carrier positions P1 represents the position at which controller 26 has commanded carrier motor 44 to begin deceleration of printhead carrier 32 from a printhead carrier velocity V1 toward a printhead carrier velocity V2. The deceleration rate may be, for example, 1.5 g's. Carrier position P2 represents the position at which printhead carrier 32 achieves printhead carrier velocity V2. Velocity V2 may be selected to be significantly lower than velocity V1, such as for example, wherein velocity V1 is about 10 times, or more, higher than velocity V2, e.g., V1+10V2. In one embodiment, for example, velocity V1 was selected to be about 500 millimeters (20 inches) per second and velocity V2 was selected to be about 38 millimeters (1.5 inches) per second. It has been found that as velocity V2 is reduced, the relative amount of noise generated upon contact between printhead carrier 32 and carrier engagement member 74 of maintenance sled 70 is reduced as well.

Carrier position P3 is the position at which printhead carrier 32 contacts carrier engagement member 74 of maintenance sled 70. Carrier position P3 is separated by a distance D1 from carrier position P2, so as to insure that the speed of printhead carrier 32 has achieved a steady state velocity at velocity V2 prior to printhead carrier 32 contacting carrier engagement member 74, and so as to minimize the noise that will accompany such contact. The actual separation distance D1 between carrier position P2 and carrier position P3 may be selected empirically so as to account for component tolerances, and may be, for example, in a range of 0.1 millimeters (mm) to 1.0 mm, and in one embodiment, was selected to be about 0.8 mm.

Carrier position P4 is the soft stop position for printhead carrier 32. Soft stop carrier position P4 is separated by a distance D2 from carrier hard stop position H1, so as to avoid an impact between printhead carrier 32 and side frame 29*a* of imaging apparatus frame 29, and accordingly, to avoid the noise that would accompany such an impact. For example, assuming a printhead capping operation, following the reaching of carrier position P3 printhead carrier 32 continues the leftward movement in direction 52*a* toward carrier position P4, thereby driving maintenance sled 32 to the capping elevation. If printhead carrier 32 overshoots carrier position P4, then an impact between printhead carrier 32 and side wall 29*a* of imaging apparatus frame 29 may occur if the separation distance D2 is not sufficient. Thus, the separation distance D2 between soft stop carrier position P4 and carrier hard stop position H1 may be selected empirically, and may be selected to be greater than the minimum movement increment of printhead carrier 32, including any component tolerances. Such a separation distance for distance D2 may be, for example, about 1.0 mm or greater, and in one embodiment, was selected to be about 1.5 mm. Upon arrival of printhead carrier 32 at carrier position P4, controller 26 controls carrier motor 44 in an active brake/hold state for 50 milliseconds, so as to ensure that the printhead caps are seated over their respective printheads.

The components and operational details for maintenance house 28 will now Be described in further detail with respect to FIG. 4.

Figure 4:
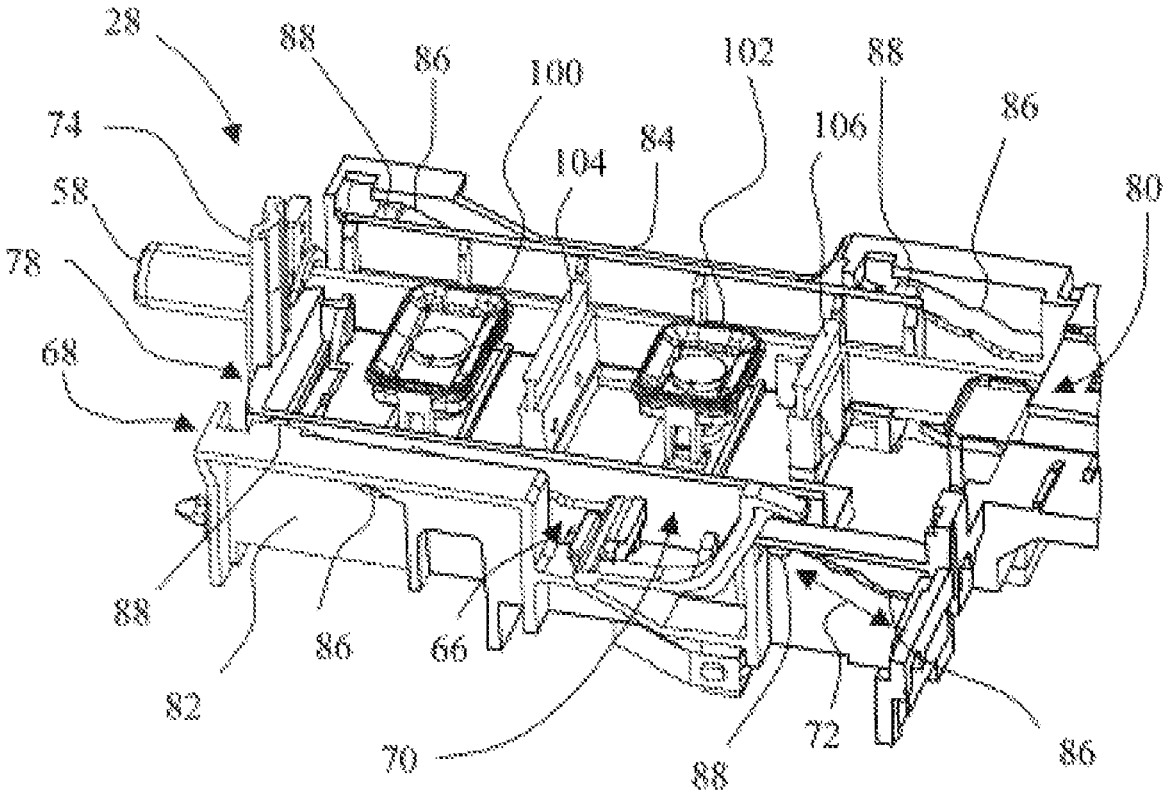
FIG. 4 is a perspective view of a maintenance station included in the imaging apparatus of FIG. 2.

As shown in FIG. 4, maintenance housing 68 includes a first end portion 78, a second end portion 80, a first side 82 and a second side 84. First end portion 78 is spaced apart from second end portion 80, and first side 82 is spaced apart from second side 84. First side 82 and second side 84 have formed therein a plurality of guide slots, reference herein individually and collectively with element number 86.

Maintenance sled 70 is positioned between first end portion 78 and second end portion 80, and is positioned between first side 82 and second side 84. Maintenance sled 70 has a plurality guide members, referenced herein individually and collectively with element number 88. Each of the plurality of guide members 88 is positioned to slidably travel in a corresponding one of plurality of guide slots 86. Thus, maintenance sled 70 is movably mounted to maintenance housing 68 via the interaction between guide slots 86 and guide members 88.

Figure 5:
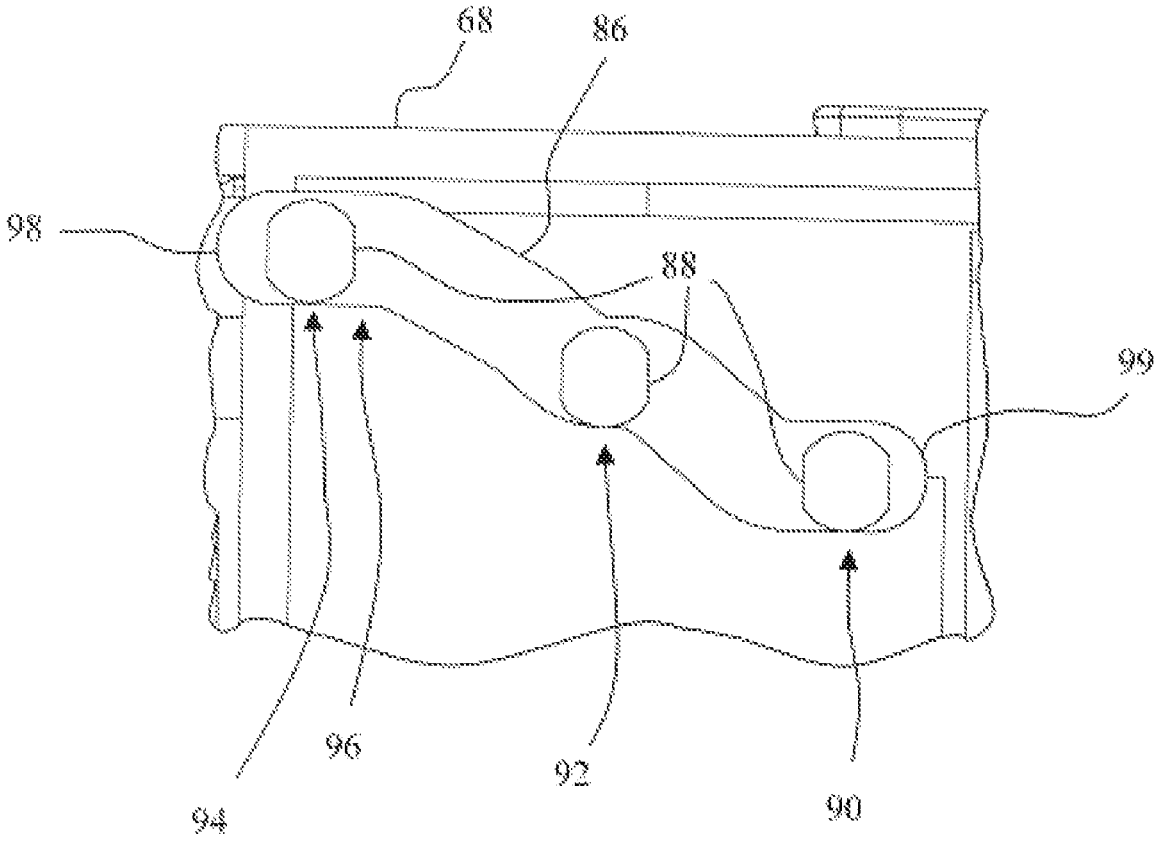
FIG. 5 is a close-up partial side view illustrating three elevations associated with the maintenance sled of the maintenance station of FIG. 4.

FIG. 5 shows a close-up partial side view of a guide slot 86 showing an exemplary cam profile, shape and orientation thereof. One guide member 88 of maintenance sled is shown in each of three exemplary elevations: a lowered, or splitting/rest, position 90; an intermediate, or wiping, position 92; and a fully raised, or capping, position 94. An extra dwell 96 of about 2 mm is included at the capping elevation to insure that maintenance sled 70 does not stop too close to the ramp leading to the capping elevation, and thereby preventing an unintentional uncapping of the capped printheads if guide members 88 were to slide down the ramp after printhead capping. Also, as best seen in FIG. 5, each of guide slots 86 has slot-ends 98, 99. A travel limit of maintenance sled 70 and a horizontal extent of the plurality of guide slots 86 are set such that the plurality of guide members 88 do not contact slot-ends 98, 99 of the plurality of guide slots 86. For example, when printhead carrier 32 is in its carrier soft stop (home) position, i.e. carrier position P4 (see FIG. 3) corresponding to maintenance sled 70 being in capping position 94, guide members 88 do not contact the slot ends 98.

Referring again to FIG. 4, mounted to maintenance sled 70 are a monochrome printhead cap 100 and a color printhead cap 102. Also mounted to maintenance sled 70 are a flexible member 104 and a flexible member 106. Flexible member 104 serves as a monochrome printhead wiper. Flexible member 106 serves as a color printhead wiper.

Figure 6:
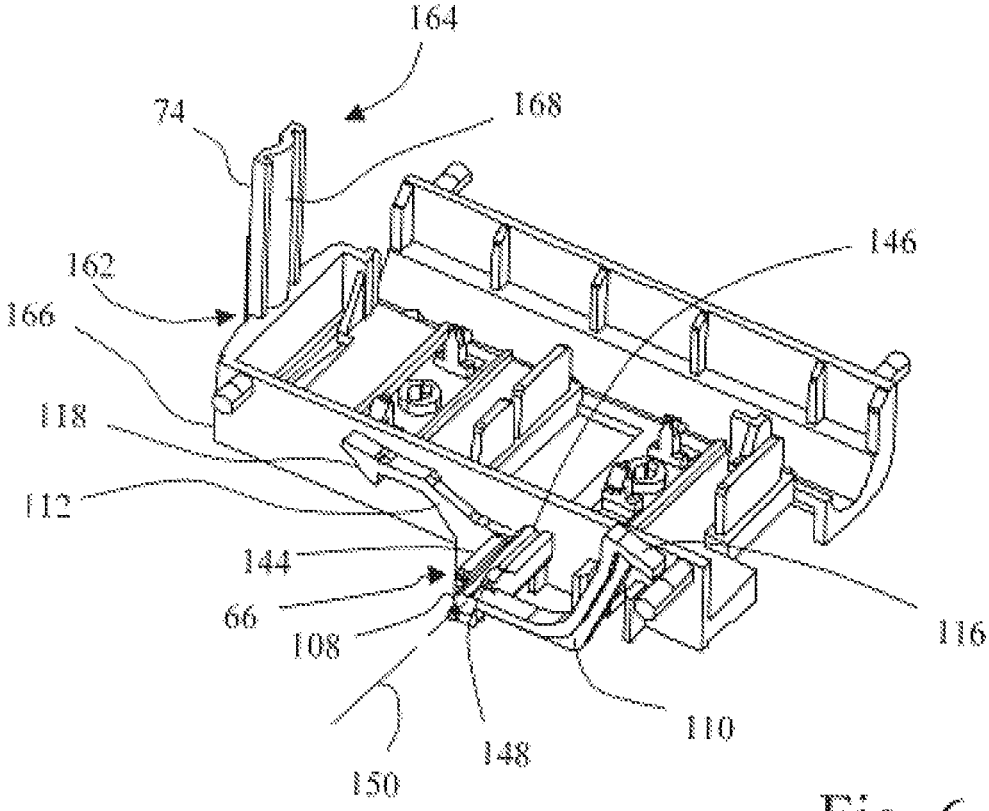
FIG. 6 is a perspective view of the maintenance sled and sled latch mechanism removed from the maintenance housing of the maintenance station of FIG. 4.
Figure 7:
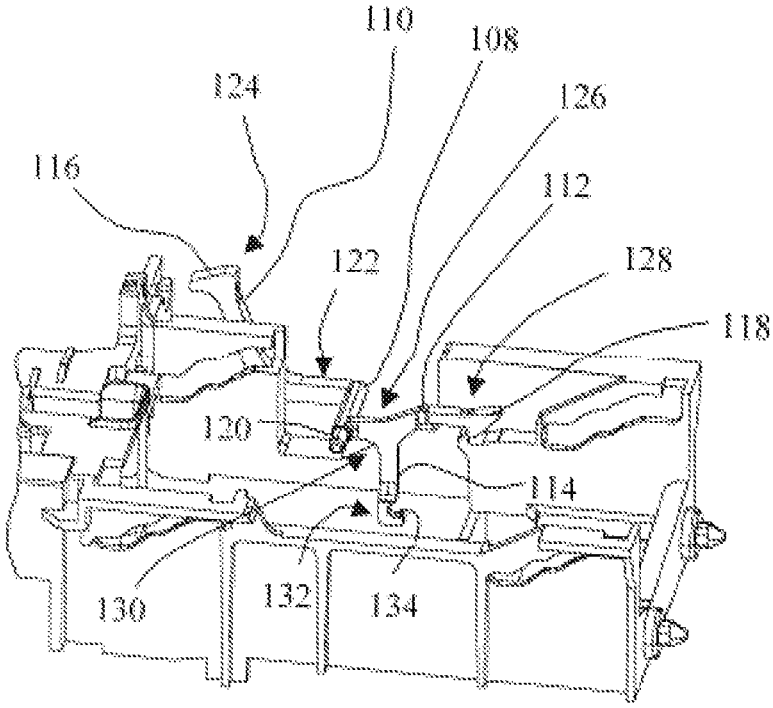
FIG. 7 is a perspective view of the maintenance housing and sled latch mechanism of the maintenance station of FIG. 4, with the maintenance sled removed.
Figure 8:
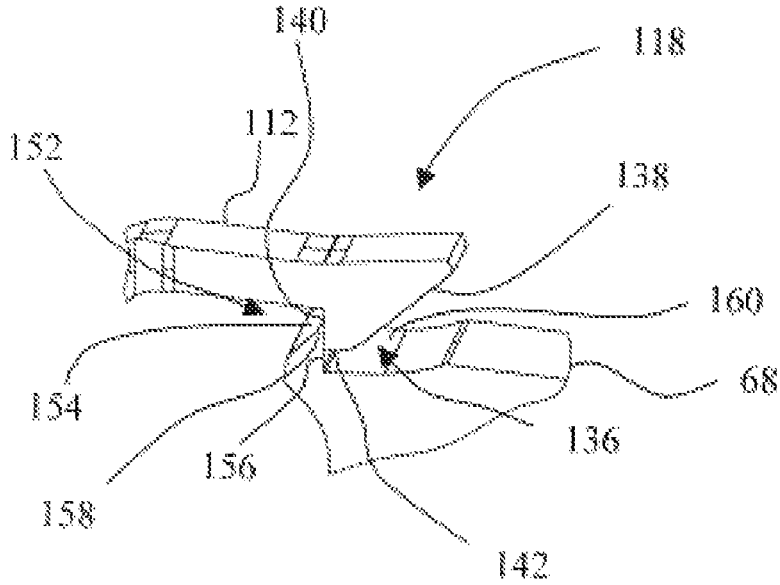
FIG. 8 is a close-up partial perspective view of the latching head of the sled latch mechanism shown in FIGS. 6 and 7.

FIGS. 6, 7 and 8 are used to explain the interaction of sled latch mechanism 66 with maintenance sled 70 and maintenance housing 68.

FIG. 6 shows maintenance sled 70 and sled latch mechanism 66 removed from maintenance housing 68 to more clearly show the mounting of sled latch mechanism 66 to maintenance sled 70. The orientation of maintenance sled 70 and sled latch mechanism 66 in FIG. 6 is the same as that shown in FIG. 2. FIG. 7 shows maintenance housing 68 and sled latch mechanism 66 with maintenance sled 70 removed. The orientation of maintenance housing 68 and sled latch mechanism 66 as shown in FIG. 7 is opposite to that shown in FIG. 2 and FIG. 6.

Referring to FIGS. 6-8, sled latch mechanism 66, which may be a unitary structure, includes a pivot shaft 108, a release extension arm 110, a latch extension arm 112, a spring extension arm 114, a release head 116 and a latch head 118. Located on one end of pivot shaft 108 is a pivot pin 120. Release extension arm 110 and latch extension arm 112 extend generally in opposite directions with respect to pivot shaft 108.

A proximal end 122 of release extension arm 110 is connected to pivot shaft 108. Release head 116 is formed at a distal end 124 of release extension arm 110. Release head 116 is positioned by release extension arm 110, when fully biased by biasing spring 76, to engage printhead carrier 32 so as to release maintenance sled 70 from the wiping elevation as printhead carrier 32 leaves maintenance station 28.

A proximal end 126 of latch extension arm 112 is connected to pivot shaft 108. Latch head 118 is formed at a distal end 128 of latch extension arm 112.

Spring extension arm 114 has a proximal end 130 that is connected to latch extension arm 112. Spring extension arm 114 has a distal end 132. In the embodiment shown, spring extension arm 114 extends from latch extension arm 112 toward distal end 132 in a direction that is substantially orthogonal to the extent of latch extension arm 112. A spring hook 134 for receiving one end of biasing spring 76 is formed on distal end 132 of spring extension arm 114.

Referring to FIG. 8, latch head 118 of sled latch mechanism 66 includes a nose portion 136. Nose portion 136 defines a ramped surface 138, a latch contact surface 140 and a transition portion 142. Transition portion 142 is positioned between and separates ramped surface 138 from latch contact surface 140.

Referring again to FIG. 6, maintenance sled 70 includes a support feature 144 for supporting pivot shaft 108, and includes a hole 146 for pivotably receiving pivot pin 120 of pivot shaft 108. Formed on a portion of support feature 144 is a pivot stop member 148. Pivot stop member 148 is positioned to engage a portion of sled latch mechanism 66 so as to limit an amount a rotation thereof about a pivot axis 150 of pivot shaft 108. In the embodiment shown, pivot stop member 148 is positioned to engage release extension arm 110 at a location near pivot axis 150 of pivot shaft 108, so as to minimize the linear velocity of sled latch mechanism 66 at a point of impact with the fixed stop, thereby correspondingly minimizing the noise resulting from such impact. Thus, preferably, pivot stop member 148 is positioned as close as possible to pivot axis 150. In the embodiment show, pivot stop member 148 is positioned at about 1 mm to 4 mm from pivot axis 150.

As can be best seen in FIG. 8, maintenance housing 68 includes a nose portion 152. Nose portion 152 defines a ramped surface 154, a latch contact surface 156 and a transition portion 158. Transition portion 158 separates ramped surface 154 from latch contact surface 156. Maintenance housing 68 includes a recessed region 160 adjacent to nose portion 152 and substantially orthogonal to latch contact surface 156.

Referring now to FIGS. 7 and 8, during the latching of maintenance sled 70, a translation of nose portion 136 of latch head 118 over nose portion 152 of maintenance housing 68 occurs. More particularly, ramp surface 138 slides over ramped surface 154 of maintenance housing 68 until transition portions 142 and 158 are in contact. Thereafter, further movement of maintenance sled 70 with respect to maintenance housing 68 results in the occurrence of the latched state, wherein transition portion 142 of latch head 118 falls by the biasing force exerted by biasing spring 76 into recessed region 160. However, pivot stop member 148 is portioned so as to limit an amount of travel of nose portion 136 of latch head 118 toward recessed region 160, so as to prevent transition portion 142 of latch head 118 from falling too far and contacting maintenance housing 68, thereby preventing the noise that would be generated if the latch head were to strike the maintenance housing, as would occur in the absence of the proper sizing of recessed region 160 and/or in the absence of the proper positioning of pivot stop member 148.

Figure 9:
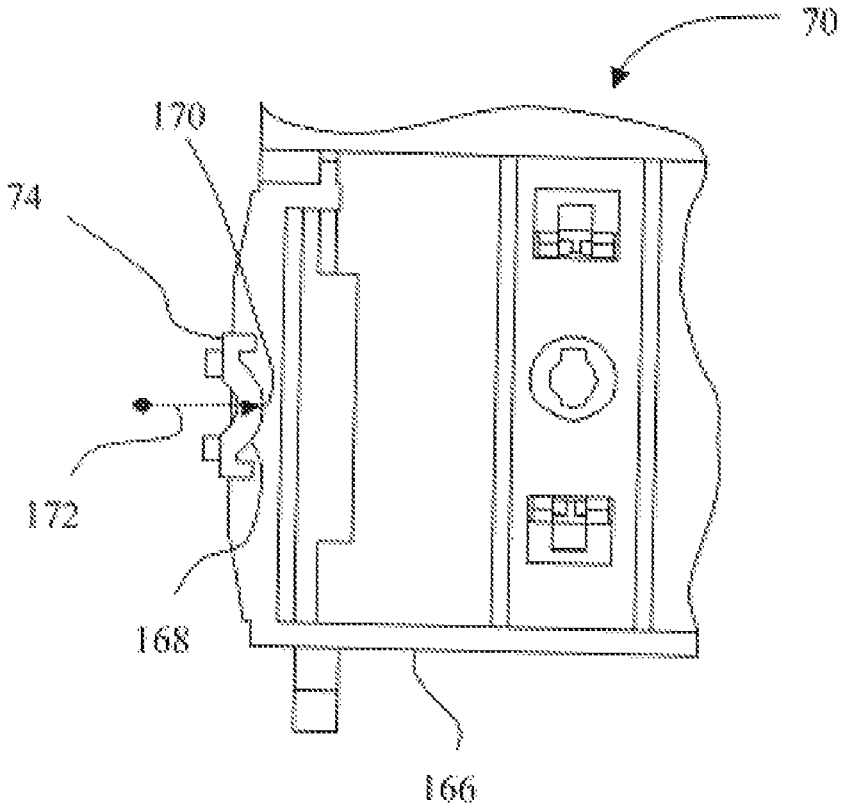
FIG. 9 is a top view of a portion of the maintenance sled of FIG. 6.

FIG. 9 shows a top view of a portion of the maintenance sled of FIG. 6, and in particular, shows an end view of carrier engagement member 74. Referring also to FIG. 6, carrier engagement member 74 includes a proximal end 162 and a distal end 164. Proximal end 162 is connected to sled body 166. Carrier engagement member 74 includes a contact surface 168 that is shaped to establish a single line of contact 170 with a surface printhead carrier 32. As shown in FIG. 9, contact surface 168 may have an arc-like shape in at least one dimension, as defined by a radius 172. Alternatively, a single line of contact may be established by shaping contact surface 168 as two or more surfaces that come together to form an abrupt line corresponding to the single line of contact 170, such as in the case where contact surface 168 has a V-like shape.

By configuring carrier engagement member 74 to establish a single line of contact 170 with printhead carrier 32, thereby defining a line-to-plane contact with printhead carrier 32, when printhead carrier reaches carrier position P3 (see FIG. 3) a diminished amount of noise is generated over that which would have been generated by a plane-to-plane contact between printhead carrier 32 and an engagement member defining a plane surface of contact.

While this invention has been described as having a preferred design, the present invention can be further modified within the spirit and scope of this disclosure. This application is therefore intended to cover any variations, uses, or adaptations of the invention using its general principles. further, this application is intended to cover such departures from the present disclosure as come within known or customary practice in the art to which this invention pertains and which fall within the limits of the appended claims.

What is claimed is:

1. An imaging apparatus, comprising:

a frame;

a maintenance housing coupled to said frame;

a maintenance sled movably mounted to said maintenance housing;

a sled latch mechanism having a pivot pin pivotably mounted to said maintenance sled along a pivot axis, and having an arm portion extending from said pivot pin; and a substantially incompressible pivot stop member positioned at about 1 mm to about 4 mm from said pivot axis, said pivot stop member engaging said arm portion of said sled latch mechanism to limit an amount of rotation of said sled latch mechanism about said pivot axis.

2. The imaging apparatus of claim 1, further comprising:

a printhead carrier coupled to said frame; and a carrier engagement member mounted to said maintenance sled, said carrier engagement member having a contact surface that is shaped to establish a single line of contact with said printhead carrier.

3. The imaging apparatus of claim 2, wherein said contact surface has an arc-like shape.

4. An imaging apparatus, comprising:

a frame defining a carrier hard stop position;

a printhead carrier coupled to said frame;

a carrier motor drivably coupled to said printhead carrier;

a controller coupled to said carrier motor, said controller controlling said carrier motor to drive said printhead carrier at least at a first velocity, said printhead carrier being controlled to move toward said carrier hard stop position, wherein prior to said printhead carrier contacting said carrier hard stop position said printhead carrier is controlled to stop at a carrier soft stop position spaced apart from said carrier hard stop position;

a maintenance sled including a carrier engagement member;

a maintenance housing coupled to said frame, said maintenance sled being movably mounted to said maintenance housing, said maintenance housing including a first nose portion defining a first latch surface, and having a recessed portion adjacent said first nose portion; and a sled latch mechanism having a pivot pin pivotablv mounted to said maintenance sled, and having a latch head including a second nose portion, said second nose portion defining a second latching surface, a ramped surface and a transition portion between said second latching surface and said ramped surface, wherein when said sled latch mechanism is in a latched state, said transition portion is received in said recessed portion of said maintenance housing but does not contact said maintenance housing, and said first latch surface is in contact with said second latch surface.

5. The imaging apparatus of claim 4, further comprising:

said maintenance housing having a first side and a second side, said first side being spaced apart from said second side, said first side and said second side having formed therein a plurality of guide slots, each of said plurality of guide slots having slot-ends; and said carrier engagement member being positioned for engagement with said printhead carrier, said maintenance sled being positioned between said first side and said second side, said maintenance sled having a plurality of guide members, each of said plurality of guide members being positioned to slideably travel in a corresponding one of said plurality of guide slots, wherein a travel limit of said maintenance sled is set such that said plurality of guide members do not contact said slot-ends of said plurality of guide slots.

6. The imaging apparatus of claim 4, wherein said pivot pin is pivotably mounted to said maintenance sled along a pivot axis, and said sled latch mechanism having an arm portion extending from said pivot pin, said imaging apparatus further comprising a substantially incompressible pivot stop member positioned immediately adjacent to said pivot axis, said pivot stop member engaging said arm portion of said sled latch mechanism to limit an amount of rotation of said sled latch mechanism about said pivot axis.

7. The imaging apparatus of claim 6, wherein said pivot stop member limits an amount of travel of said second nose portion toward said recessed portion of said maintenance housing.

8. The imaging apparatus of claim 4, further comprising:

an arm portion extending from said pivot pin, said carrier engagement member being positioned for engagement with said printhead carrier, and said pivot pin being pivotably mounted to said maintenance sled along a pivot axis; and a substantially incompressible pivot stop member positioned immediately adjacent to said pivot axis, said pivot stop member engaging said arm portion of said sled latch mechanism to limit an amount of rotation of said sled latch mechanism about said pivot axis.

9. The imaging apparatus of claim 8, wherein said pivot stop member is positioned at about 1 mm to about 4 mm from said pivot axis.

10. The imaging apparatus of claim 4, wherein at said carrier soft stop position, said controller controls said carrier motor in an active brake/hold state.

11. The imaging apparatus of claim 10, wherein said active brake/hold state is performed for about 50 milliseconds.

12. The imaging apparatus of claim 4, wherein said carrier engagement member has a contact surface that is shaped to establish a single line of contact with said printhead carrier.

13. The imaging apparatus of claim 12, wherein said contact surface has an arc-like shape.

14. An imaging apparatus, comprising:

a frame defining a carrier hard stop position;

a printhead carrier coupled to said frame;

a carrier motor drivably coupled to said printhead carrier;

a controller coupled to said carrier motor, said controller controlling said carrier motor to drive said printhead carrier at least at a first velocity, said printhead carrier being controlled to move toward said carrier hard stop position, wherein prior to said printhead carrier contacting said carrier hard stop position said printhead carrier is controlled to stop at a carrier soft stop position spaced apart from said carrier hard stop position;

a maintenance housing coupled to said frame;

a maintenance sled movably mounted to said maintenance housing;

a sled latch mechanism having a carrier engagement member positioned for engagement with said printhead carrier, and having a pivot pin pivotably mounted to said maintenance sled along a pivot axis, and having an arm portion extending from said pivot pin; and a substantially incompressible pivot stop member positioned at about 1 mm to about 4 mm from said pivot axis, said pivot stop member engaging said arm portion of said sled latch mechanism to limit an amount of rotation of said sled latch mechanism about said pivot axis.

15. The imaging apparatus of claim 14, further comprising:

said maintenance housing having a first side and a second side, said first side being spaced apart from said second side, said first side and said second side having formed therein a plurality of guide slots, each of said plurality of guide slots having slot-ends; and said maintenance sled being positioned between said first side and said second side, said maintenance sled having a plurality of guide members, each of said plurality of guide members being positioned to slideably travel in a corresponding one of said plurality of guide slots, wherein a travel limit of said maintenance sled is set such that said plurality of guide members do not contact said slot-ends of said plurality of guide slots.

16. The imaging apparatus of claim 14, further comprising:

said maintenance housing including a first nose portion defining a first latch surface, and having a recessed portion adjacent said first nose portion; and said sled latch mechanism having a latch head including a second nose portion, said second nose portion defining a second latching surface, a ramped surface and a transition portion between said second latching surface and said ramped surface, wherein when said sled latch mechanism is in a latched state, said transition portion is received in said recessed portion of said maintenance housing but does not contact said maintenance housing, and said first latch surface is in contact with said second latch surface.

17. The imaging apparatus of claim 16, wherein said pivot stop member limits an amount of travel of said second nose portion toward said recessed portion of said maintenance housing.

18. The imaging apparatus of claim 14, wherein at said carrier soft stop position, said controller controls said carrier motor in an active brake/hold state.

19. The imaging apparatus of claim 18, wherein said active brake/hold state is performed for about 50 milliseconds.

* * * * *